US005289920A

United States Patent [19]

Godderidge et al.

[11] Patent Number: 5,289,920

[45] Date of Patent: Mar. 1, 1994

[54] PROCESS FOR THERMICALLY RECOVERING OLD SANDS OBTAINED IN CASTING PLANTS AND FOR TREATING THE DUSTS OBTAINED DURING CIRCULATION OF THE SAND

[75] Inventors: Volker Godderidge, Altirdning, Austria; Walter Stuzmann, Meerbusch, Fed. Rep. of Germany

[73] Assignee: KGT Giessereitechnik GmbH, Dusseldorf, Fed. Rep. of Germany

[21] Appl. No.: 698,402

[22] Filed: May 10, 1991

[30] Foreign Application Priority Data

May 10, 1990 [DE] Fed. Rep. of Germany ..... 4015031

[51] Int. Cl.[5] ..... B03B 9/04; F27B 15/00

[52] U.S. Cl. ..... 209/2; 110/236; 134/10; 209/11; 241/DIG. 10; 432/56

[58] Field of Search ..... 209/2, 3, 11, 20, 12; 134/10, 19, 22.1; 432/58, 106; 241/DIG. 10; 164/5; 110/236, 245

[56] References Cited

U.S. PATENT DOCUMENTS

| | | | |
|---|---|---|---|
| 4,144,088 | 3/1979 | Adams | 209/10 X |
| 4,303,453 | 12/1981 | Jung et al. | 209/3 X |
| 4,437,834 | 3/1984 | Vogel | 164/5 X |
| 4,478,572 | 10/1984 | Selli | 164/5 X |
| 4,821,654 | 4/1989 | Becker et al. | 241/DIG. 10 |
| 5,069,171 | 12/1991 | Hansen et al. | 432/58 X |
| 5,073,107 | 12/1991 | Lask | 432/58 X |

FOREIGN PATENT DOCUMENTS

| | | | |
|---|---|---|---|
| 2508630 | 9/1975 | Fed. Rep. of Germany | 164/5 |
| 0000140 | 1/1979 | Japan | 164/5 |

*Primary Examiner*—Donald T. Hajec
*Attorney, Agent, or Firm*—Locke Reynolds

[57] ABSTRACT

A process for thermically recovering old sand obtained in casting plants and for treating dust containing combustible organic components and incombustible inorganic components is disclosed. Dust obtained by mechanical preparation of the old sand is separated from the sand. The sand is used to form a fluid bed in a fluid-bed kiln having a post-combustion space and an outlet for releasing combustion gases. Dust containing combustible organic components and incombustible inorganic components is introduced into the fluid bed, the combustion of the organic components being used to maintain reaction temperature in the fluid bed. The heat of the fluid bed and the post-combustion space deactivates inorganic components of the dust, which are transported by released combustion gases to effectively separate the inorganic components of the dust from the thermically recovered old sand. These deactivated inorganic components of the dust can be separated from the released combustion gases for easy disposal.

4 Claims, 1 Drawing Sheet

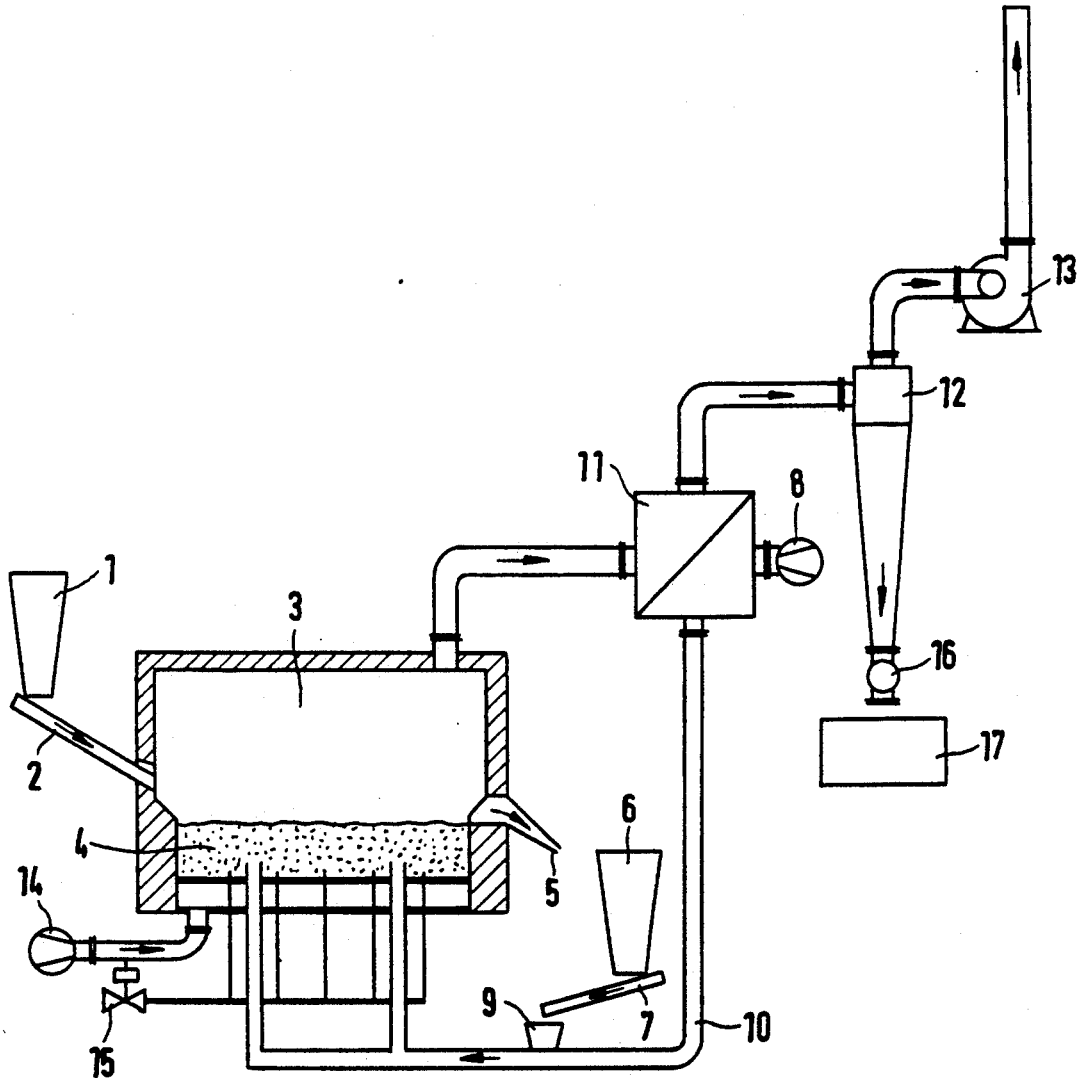
1
2
3
4
5
6
7
8
9
10
11
12
13
14
15
16
17

PROCESS FOR THERMICALLY RECOVERING OLD SANDS OBTAINED IN CASTING PLANTS AND FOR TREATING THE DUSTS OBTAINED DURING CIRCULATION OF THE SAND

The invention relates to a process for thermically recovering old sand obtained in casting plants by use of a fluid bed kiln having a fluid bed and a post combustion space. The fluid bed is heated in part by heat exchanger positioned at an air outlet.

Processes for recovery of old sand from the sand molds of metal casting plants are generally known. Recovery of old sand derived from these casting plants initially requires at least a coarse preparation in which big lumps of sand are smashed with mechanical mechanisms such as hammer mills. After mechanical preparation, cast residue are separated from the old sand by magnet separators. Dust components obtained during mechanical preparation are separated through air sifters. Possible further stages of mechanical treatment can also be employed prior to thermal treatment of the old sand.

Fluid-bed techniques are typically applied in many industrial process. A fluid bed is formed from dust and fine- to coarse-grained solids and an upwelling or turbulent gas blown in from below the solids. Both exothermic and endothermic processes can be maintained in the fluid-bed. For example, a pulverized coal can be introduced into the fluid bed as fine-grained solids to promote an exothermic reaction. However, it is not necessary to introduce a solid fuel to maintain an exothermic reaction in a fluid bed. Known fluid-bed processes having exothermic reactions in which no fuel in the form of a solid is employed for heating the fluid bed include burning sulphidic ores such as pyrite, galenite or sphalerite inside the fluid bed. Known fluid-bed processes having endothermic reactions include drying, calcining and sintering of pulverized or granular loose material.

In a known process for transferring the heat obtained in the fluid bed of a fluid-bed kiln to a heat-consuming process (German Printed Publication 32 32 481 Al), the exothermic and endothermic processes inside said fluid-bed kiln occur separate from each other. For this purpose, a fluid bed is formed in the interior of the fluid-bed kiln. In that region of the bottom of said kiln is introduced noncaking material such as coal, garbage, metallic dusts or the like for an creating an exothermic combustion process. The bottom of the kiln is designed to distribute gas, being centrally provided at the end of a tapering section with a discharge opening for the exothermic reaction product. Friable solids such as resinous old sand to be calcined, quartz sand, or clay is passed through the fluid-bed kiln by a heat exchanging piping system passing through the fluid bed kiln. The piping system eventually feeds into an external container from which the recovered material may then be drawn off. This known fluid-bed kiln arrangement is particularly suited for preparing or changing heavy materials such as burning sulphidic ores. This known process, with appropriately modified apparatus design, can also be employed for preparing and changing lightweight materials such as resinous binding agents or residue of binding agents that may adhere to old sand.

The state of the art, moreover, encompasses burning carbonaceous materials in fireboxes having a stationary fluid bed. When a firebox is put in use, solid material is drawn off from the fluid-bed combustion chamber. This bed material as a whole can consist of the ash and the inert material employed, such as quartz sand. The bed material contains fines which can be fed anew to the fluid bed (German Patent Specification 31 07 355).

From British Printed Publication 20 77 614, an apparatus has become known in which the drawn-off material is subjected to air sifting. Air sifting involves directly heating air using at least a part of the drawn off material from the fluid bed prior to bringing the air into contact with the fluid bed. After having been brought into contact with the drawn-off fluid-bed material, the air absorbs heat, whereafter it is again fed to the combustion space of the fluid-bed firebox together with the fines of the bed material via a delivery pipe additionally charged with air.

Departing from this state of the art, the objective of the present invention is to provide a process for deactivating dusts from the old sand obtained in casting plants, these dusts being created during reprocessing due to the separation of cast and sand, followed by sieving, classifying, mixing and the like mechanical comminuting measures. In addition, an object of the present invention is to minimize the energy required to treat this dust.

According to the invention, thermically recovering old sand obtained in casting plants and treating the dusts obtained during circulation of the sand involves use of a fluid-bed kiln having a fluid bed and a post-combustion space, as well as a heat exchanger on the side of the air outlet. The recovery process is characterized by heating the fluid bed to a reaction temperature, using to a considerable extent heat derived from exothermic burning of an organic fraction of the dust. This organic fraction of the dust is obtained during mechanical preparation of the old sand. The non-combustible non-organic components of the dust fraction are deactivated by sintering and/or calcining processes that occur, at the latest, during post combustion in the fluid bed kiln. Further the recovered material and the deactivated dust fed through the heat exchanger are made to separately leave the course of the process.

In other embodiments of the present invention, the dust can be introduced into the fluid bed in temperature-dependent metered manner. The dust can be blown into the fluid bed by means of air preheated through a heat exchanger. Ignition and combustion of the organic combustible portion of the dust occurs in the fluid bed and post-combustion is effected in the post-combustion chamber located above said fluid bed. In this embodiment, as well as other embodiments of the invention, starting up the fluid-bed kiln is effected by an external energy source such as combustion gases, at least until the fluid bed is heated to reaction temperature.

Mixing the dust obtained during preliminary mechanical cleaning of the old sand, the old sand itself, and a considerable portion of combustible organic components separated prior to thermal preparation of the sand, results in a pulverized material having an exothermic energy balance. Thermal preparation of the old sand begins once the dust components obtained have been separated in a fluid-bed kiln, the old sand, by itself, constituting the fluid bed. Advantageously, endothermic preparation of the old sand is effected by use of the exothermic process of burning the organic dust component inside said fluid bed.

In addition to having a positive energy balance, the inorganic non-combustible components of the dust not deactivated in the fluid bed can be deactivated in the post-combustion zone located above the fluid bed. The mechanical preparation of the sand precedes the thermal preparation of the old sand. Easy separation of the dusts for the process according to the invention are enabled, for example, by sucking off and separating the dusts in known conventional filtering installations. The dusts substantially consist of a fine-grained quartz fraction, possibly other organic materials such as clay particles, and quite a considerable amount of organic components derived from pulverized compounds of resin. If such dust mixtures were not recycled, they would have to be taken to extra dumps, considerably increasing disposal costs. When the dusts are deactivated according to the present invention, it is not necessary to transport dust to extra garbage dumps and the energy balance of thermal prepration of the old sand is considerably enhanced.

Blowing dust obtained from the circulation of the sand in a casting plant into the fluid bed is simply effected through the bottom of the fluid-bed kiln by use of air that passes through a heat exchanger to preheat it. The preheated air serves as transport medium as well as delivering gas to maintain the fluid bed. Thus, direct use of the combustible ingredients of the dusts to for substitute for primary energy initially heating the fluid-bed kiln. Deactivation of the non-combustible inorganic components of the dust is effected practically simultaneously with thermic recovery of the old sand of the casting plant. The waste heat of the fluid-bed kiln is used for preheating air blown into the fluid bed.

By way of example, a form of construction of an apparatus for carrying out the process according to the invention is shown in the attached FIG. This FIG. is hereinafter explained in more detail with reference to the apparatus.

As can be seen from the FIG., the interior of the fluid-bed kiln is divided into the lower fluid bed 4 and the upper post-combustion space 3, the fluid bed, as usual, being separated from the chamber for the incoming turbulent gas flow by a perforated bottom or the like orifice plate. Old sand 1 obtained from mechanical preliminary cleaning is introduced into the fluid-bed kiln through a metering device 2 as illustrated. This old sand is substantially free of the fine dust separated during preliminary sand cleaning. Thus, the old sand by itself constitutes the fluid bed 4, the residence time of which in the interior of said kiln is controlled in such a way that the combustible binding agent residue, still adhering thereto, are burned inside the fluid bed 4. Secondarily, calcination of inorganic dust components occurs in the fluid bed as the occasion arises. The recovered material 5 obtained during this thermal recovery is discharged from the kiln so as to be thus available to the remaking of molds used in casting plants.

During the starting-up phase of the fluid-bed kiln 3, 4, a layer of sand in the kiln is first heated by means of an external energy source that provides a combustible gas until a given rated temperature, generally of 500° to 900° Centrigrade, is reached. The combustible gas can be metered through a valve 15, being fed into an oncoming flow sped up by means of a fan 14. After the rated temperature has been reached inside the fluid bed 4, the dust obtained from the circulation of the sand is separated from the sand and is introduced from below into said fluid bed 4 via a dust charger 6 and a metering feeder 7 as well as an intermediate hopper 9. On this occasion, air serves as medium for passing the dust through a manifold 10, the air having been preheated by means of a heat exchanger 11. The heat exchanger 11 is connected between the outlet of the post-combustion chamber 3 of said fluid-bed kiln and a fan 8 through which fresh air is admitted, the latter subsequently leaving the heat exchanger via said manifold 10 in the desired preheated form. The hot air, now cooled off, from the fluid-bed kiln is fed by the heat exchanger 11 to a separator 12 which may be, for example, a cyclone separator or a suitable filtering device by means of which the deactivated calcined dusts are purged into the environment through a blower 13 prior to the discharge of the outlet air.

The dust, together with its organic combustible ingredients, is metered into the manifold 10 via extra lances or the like for forming a combustible mixture of dust and air. Depending upon the present heating value of the dust, the flow of the combustible gas may be diminished or even completely shut off by the valve 15 so that heating of the fluid bed and maintenance of the rated temperature inside the same are effected exclusively through control of dust passing into the fluid bed. The metering rate required for this purpose may be controlled through a feedback circuit known per se. Deactivated dust obtained in the separator 12 is discharged from the described piping system via a cellular wheel sluice 16 or the like and collected in a container 17. To this collecting vessel, a pelletizing mixer may for example be allotted, but the collecting vessel may also be designed as such a mixer.

The dust, fed into the fluid bed 4 via the manifold 10 and burning during its passage therethrough, will be subjected to post-combustion in the post-combustion chamber 3 to ensure that it leaves the fluid-bed kiln in completely deactivated form.

We claim:

1. A process for thermically recovering old sand obtained in casting plants and for treating dust containing combustible organic components and incombustible inorganic components, the dust being obtained by mechanical preparation of the old sand, the process comprising the steps of forming a fluid bed from the old sand in a fluid-bed kiln having a post-combustion space and an outlet for releasing combustion gases, introducing dust containing combustible organic components and incombustible inorganic components into the fluid bed, the combustion of the organic components being used to maintain reaction temperature in the fluid bed, deactivating inorganic components of the dust in the post combustion space, transporting the deactivated inorganic components of the dust with the released combustion gases to separate the inorganic components of the dust from the thermically recovered old sand, and separating the deactivated inorganic components of the dust from the released combustion gases.

2. A process according to claim 1, further comprising the step of controlling the amount of dust introduced into said fluid bed to maintain a constant reaction temperature in the fluid bed.

3. A process according to claim 1, further comprising the step of blowing dust into the fluid bed with air preheated through a heat exchanger connected to absorb heat from the outlet of fluid bed kiln.

4. A process according to claim 1, further comprising the step of starting the fluid-bed kiln with foreign energy from combustible gases until the fluid bed is heated to reaction temperature.

* * * * *